US008356697B2

(12) United States Patent
Kriss et al.

(10) Patent No.: US 8,356,697 B2
(45) Date of Patent: Jan. 22, 2013

(54) ELEVATOR SAFETY SYSTEM AND METHOD

(75) Inventors: John J. Kriss, East Hampton, CT (US); Loren D. Fanion, Forestville, CT (US); Fred R. Spielman, Somers, CT (US); Daniel R. Greer, Bristol, CT (US)

(73) Assignee: Otis Elevator Company, Farmington, CT (US)

( * ) Notice: Subject to any disclaimer, the term of this patent is extended or adjusted under 35 U.S.C. 154(b) by 576 days.

(21) Appl. No.: 11/992,609

(22) PCT Filed: Oct. 25, 2005

(86) PCT No.: PCT/US2005/038573

§ 371 (c)(1),
(2), (4) Date: May 10, 2010

(87) PCT Pub. No.: WO2007/050060

PCT Pub. Date: May 3, 2007

(65) Prior Publication Data

US 2010/0206668 A1 Aug. 19, 2010

(51) Int. Cl.
*B66B 9/00* (2006.01)

(52) U.S. Cl. ..... 187/249; 187/288; 187/393

(58) Field of Classification Search ..... 187/247, 187/248, 249, 288, 391, 393
See application file for complete search history.

(56) References Cited

U.S. PATENT DOCUMENTS

| | | | | |
|---|---|---|---|---|
| 1,896,777 | A | 12/1930 | James | |
| 5,663,538 | A * | 9/1997 | Sakita | 187/382 |
| 5,877,462 | A * | 3/1999 | Chenais | 187/249 |
| 6,554,107 | B2 * | 4/2003 | Yumura et al. | 187/247 |
| 7,353,912 | B2 * | 4/2008 | Reuter et al. | 187/249 |
| 7,448,471 | B2 * | 11/2008 | Nuebling | 187/286 |
| 7,779,967 | B2 * | 8/2010 | Kocher et al. | 187/249 |
| 7,819,228 | B2 * | 10/2010 | Terry et al. | 187/249 |
| 7,857,103 | B2 * | 12/2010 | Kocher | 187/249 |
| 7,857,104 | B2 * | 12/2010 | Kocher | 187/249 |
| 7,980,362 | B2 * | 7/2011 | Kostka | 187/249 |
| 8,020,668 | B2 * | 9/2011 | Hsu et al. | 187/249 |
| 8,136,635 | B2 * | 3/2012 | Christy et al. | 187/249 |
| 2005/0279584 | A1 | 12/2005 | Reuter et al. | |
| 2006/0175135 | A1 | 8/2006 | Meissner et al. | |

FOREIGN PATENT DOCUMENTS

| | | | |
|---|---|---|---|
| JP | 59153773 | A | 9/1984 |
| JP | 1117189 | A | 5/1989 |
| JP | 6305648 | A | 11/1994 |
| JP | 7172716 | A | 7/1995 |
| JP | 8157153 | A | 6/1996 |
| JP | 9165156 | A | 6/1997 |

(Continued)

OTHER PUBLICATIONS

Japanese Office Action, Sep. 20, 2011, 4 pages.

(Continued)

*Primary Examiner* — Anthony Salata

(74) *Attorney, Agent, or Firm* — Kinney & Lange, P.A.

(57) ABSTRACT

An elevator safety system (10) includes a limit switch (32) coupled to a first elevator car (14) and an actuator plate (30) coupled to a governor rope (24) of a second elevator car (16). The actuator plate trips (30) the limit switch (32) when a distance between the first elevator car (14) and the second elevator car (16) goes below a safety threshold distance to stop the first and second elevator cars (14, 16).

19 Claims, 4 Drawing Sheets

FOREIGN PATENT DOCUMENTS

| | | | |
|---|---|---|---|
| JP | 2002338162 | A | 11/2002 |
| JP | 2004352411 | A | 12/2004 |
| WO | 2004043841 | A1 | 5/2004 |

OTHER PUBLICATIONS

China Office Action, Aug. 7, 2009, 4 pages.
China Office Action, English Translation, Aug. 7, 2009, 4 pages.
Text of First China Office Action, English Translation, Aug. 7, 2009, 2 pages.
European Patent Office, Extended European Search Report, May 18, 2011, 5 pages.
Official Search Report of the Patent Cooperation Treaty in counterpart foreign Application No. PCT/US05/38573 filed Oct. 25, 2005.
Office Action and Translation from Japanese Application Serial No. 2008-537653; dated Jul. 3, 2012, 6 pages.

* cited by examiner

ELEVATOR SAFETY SYSTEM AND METHOD

BACKGROUND OF THE INVENTION

The present invention relates to an elevator safety system, and more particularly to a system and method for maintaining adequate spacing between multiple cars in an elevator hoistway.

Conventional elevator systems include a single elevator car and a counterweight disposed in a hoistway, a plurality of ropes that interconnect the car and counterweight, a drive machine having a drive pulley wheel engaged with the ropes to drive the car, and a brake to mechanism to stop the movement of the car and counterweight.

Multiple cars can now be controlled within the same elevator hoistway, with one car operating above the other. The cars are controlled by a common controller that determines the most efficient ways of getting people to their appropriate destinations.

Although various safety systems have been designed to maintain an adequate distance between a single elevator car and the top or bottom of the hoistway, additional safety measures are needed to maintain an adequate distance between multiple elevator cars operating within the same hoistway.

BRIEF SUMMARY OF THE INVENTION

A multiple car elevator safety system includes a limit switch coupled to a first elevator car and an actuator plate coupled to a governor rope of a second elevator car. The actuator plate trips the limit switch when a distance between the first elevator car and the second elevator car goes below a safety threshold distance, causing a brake mechanism to engage and stop the first and second elevator cars.

DETAILED DESCRIPTION

Figure 1:
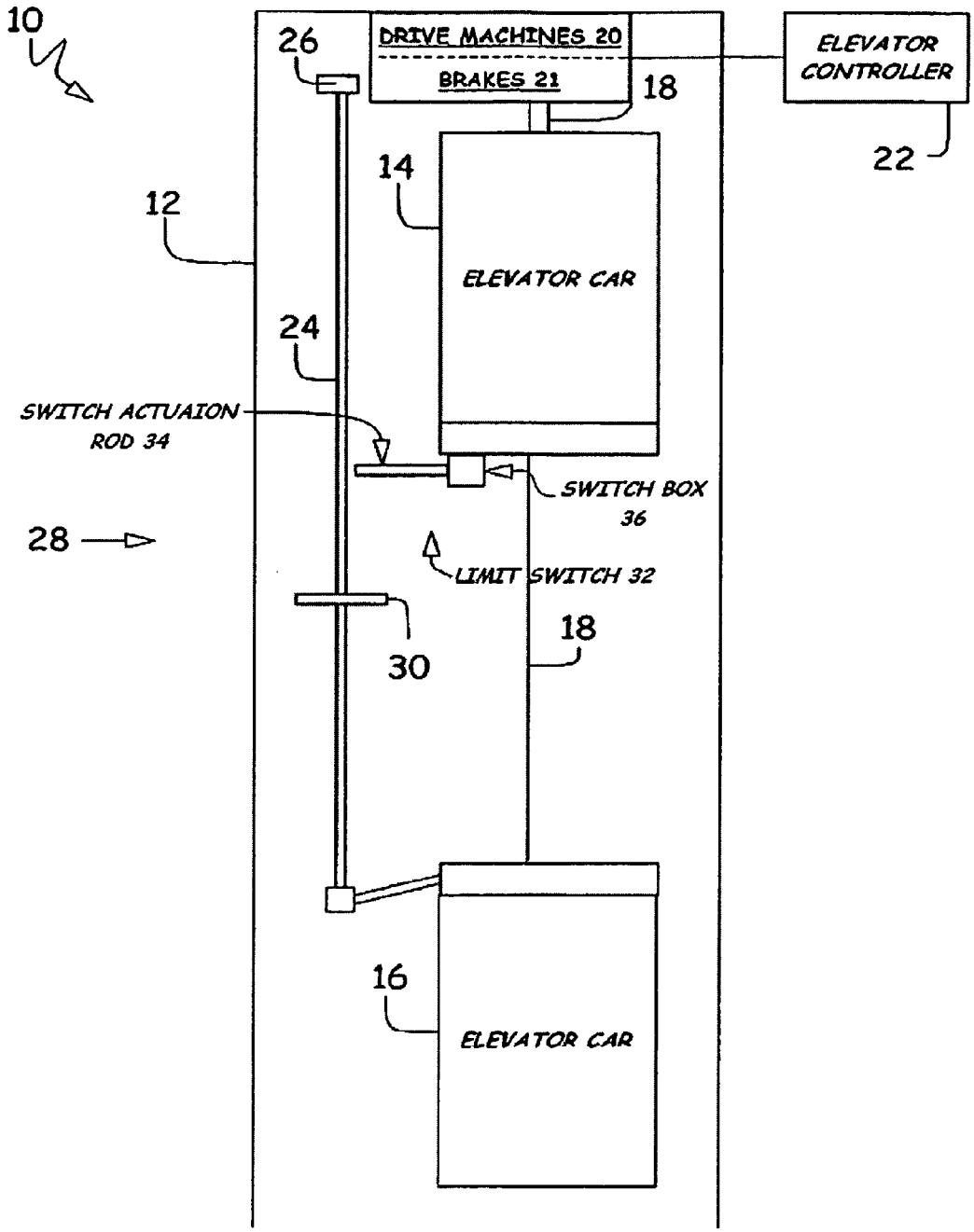
FIG. 1 is a block diagram of an elevator including an elevator safety system.

FIG. 1 is a block diagram of elevator 10 including elevator safety system 28. Elevator 10 is located in or around a building, and operates to transport people or objects from one location of the building to another location of the building. The elevator includes elevator hoistway 12, elevator car 14, elevator car 16, ropes 18, drive machines 20, brakes 21, elevator controller 22, governor rope 24, governor 26, and elevator to safety system 28. Elevator cars 14 and 16 are located within elevator hoistway 12, and elevator car 14 operates above elevator car 16. Both elevator cars 14 and 16 are capable of servicing all floors of the building. More than two elevator cars may be present within hoistway 12.

Elevator cars 14 and 16 are moved between floors by drive machines 20 under the control of elevator controller 22. Elevator cars 14 and 16 are suspended by ropes 18, which are also connected to counterweights (not shown). Drive machines 20 adjusts ropes 18 to move elevator cars 14 and 16 independently within elevator hoistway 12. Brakes 21 are used by elevator controller 22 to stop elevator cars 14 and 16 at the appropriate locations.

Governor rope 24 is connected to elevator car 16 and extends adjacent to elevator cars 14 and 16, parallel with hoistway 12. Governor rope 24 loops around governor 26, which spins as elevator car 16 moves up or down within hoistway 12. Governor 26 is a mechanical speed control mechanism that utilizes governor rope 24 to monitor the speed of elevator car 16. If governor 26 detects that elevator 16 is moving too quickly, it initiates a car safety device (not shown) to slow or stop the movement of the elevator car. Elevator car 14 also has a governor rope, not shown in FIG. 1.

When two elevator cars share the same hoistway, measures must be taken to ensure that an adequate spacing is maintained between elevator car 14 and elevator car 16. One way of maintaining adequate spacing is through elevator controller 22. Elevator controller 22 monitors the location of the elevator cars 14 and 16 at all times, and controls the movement of each elevator car in hoistway 12. Elevator controller 22 operates elevator cars 14 and 16 to maintain adequate spacing between them at all times.

However, it is desirable to have additional safety measures in place in case of a malfunction in some component of elevator 10. Therefore, elevator safety system 28 is provided. Elevator safety system 28 includes actuator plate 30 and limit switch 32. In one embodiment, actuator plate 30 is a round plate with a hole in the middle, where it is clamped to governor rope 24. Limit switch 32 includes switch actuation rod 34 and switch box 36. Limit switch 32 is attached to a lower portion of elevator car 14. Switch actuation rod 34 extends out from switch box 36, adjacent to governor rope 24. Limit switch 32 is located near governor rope 24, such that actuator plate 30 will trip switch actuation rod 34 if elevator car 14 and elevator car 16 get closer than the safety threshold distance. Actuator plate 30 and limit switch 32 are described in more detail with reference to FIG. 4.

When limit switch 32 is tripped by actuator plate 30, an electrical stop signal is sent to elevator controller 22. In one embodiment, limit switch 32 is normally closed, and opens to stop the flow of electricity when tripped by actuator plate 30. In another embodiment, limit switch 32 is normally open, and closes to allow the flow of electricity when tripped by actuator plate 30. However, it is recognized that any type of electrical stop signal could be used to communicate with elevator controller 22, including digital communication signals. Furthermore, the stop signal could be communicated from limit switch 32 to elevator controller 22 using radio frequency communications, or other known communication methods.

Once the stop signal from limit switch 32 has been received by elevator controller 22, drive machines 20 are deactivated and brakes 21 are engaged to stop the movement of elevator cars 14 and 16 within hoistway 12.

Figure 2:
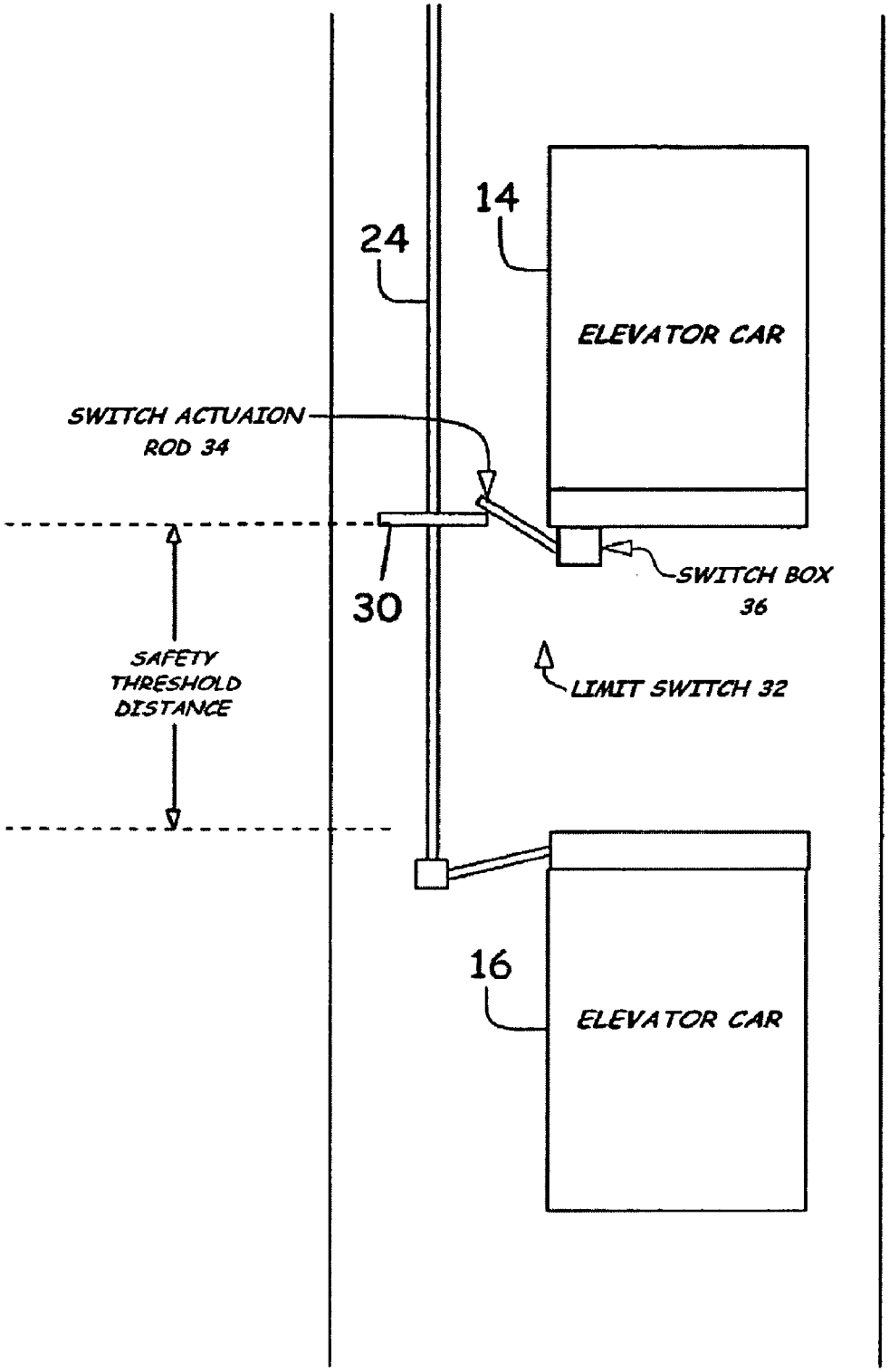
FIG. 2 is a block diagram of the elevator illustrating the operation of the elevator safety system including an actuator plate and a limit switch.
Figure 3:
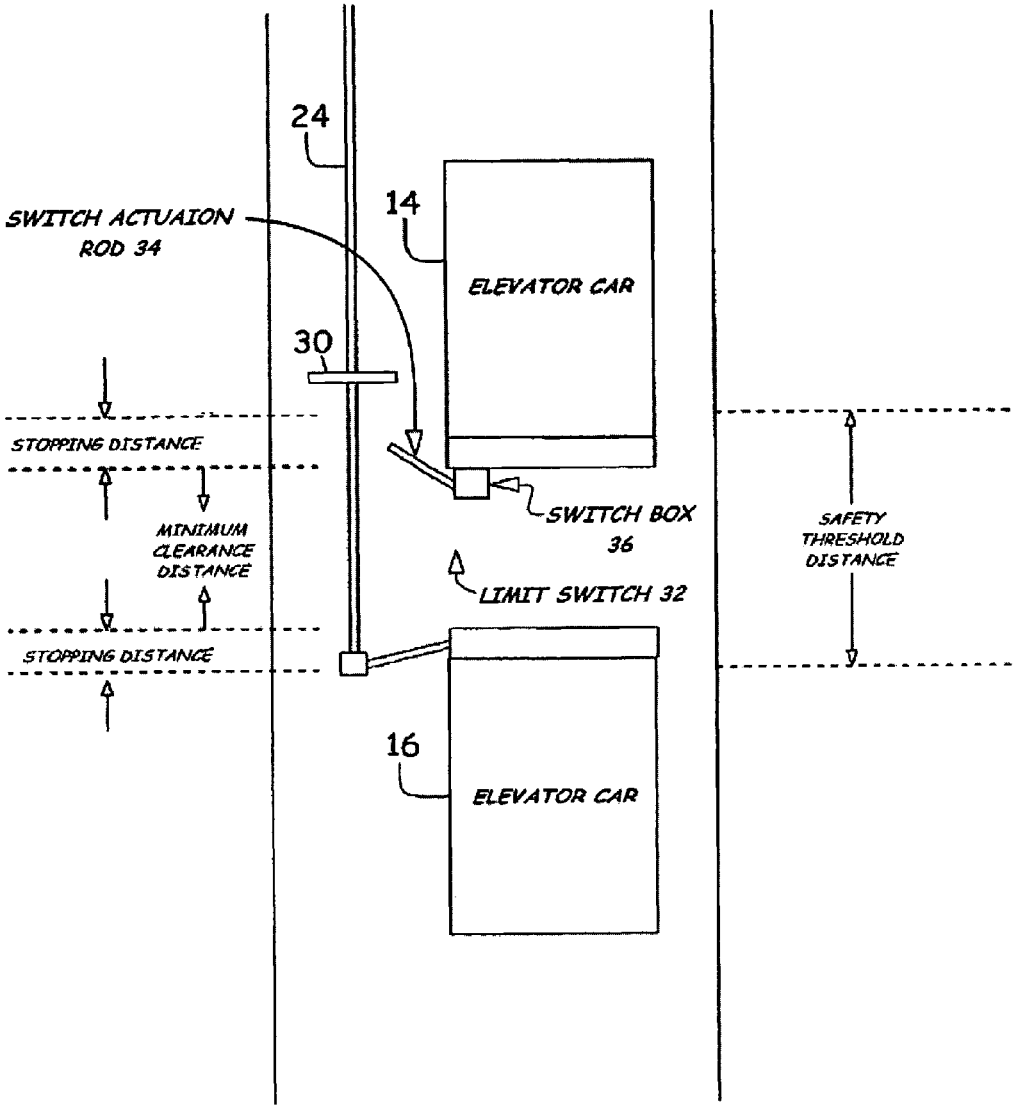
FIG. 3 is a block diagram of the elevator after actuation of the limit switch.

FIGS. 1-3 illustrate the method of stopping elevator cars 14 and 16 in more detail. In the example shown in FIG. 1, elevator cars 14 and 16 are moving toward each other, such that elevator car 14 is moving down and elevator car 16 is moving up within hoistway 12. As elevator cars 14 and 16 approach each other, limit switch 32 and actuator plate 30 also approach each other.

When elevator cars 14 and 16 get too close to each other, as shown in FIG. 2, actuator plate 30 hits actuation rod 34, causing switch actuation rod 34 to pivot, tripping limit switch 32. Limit switch 32 then sends stop signal to elevator controller 22, to inform elevator controller 22 that elevator car 14 and elevator car 16 are no longer adequately spaced from each other. Elevator controller 22 then deactivates drive machines 20 and activates brakes 21 to stop elevator car 14 and elevator car 16. Elevator cars 14 and 16 continue to move toward each other momentarily until coming to a complete stop as shown in FIG. 3.

FIG. 3 illustrates the desired location of actuator plate 30. After limit switch 32 has been tripped by actuator plate 30, elevator cars 14 and 16 will each continue moving toward each other for a distance referred to as a "stopping distance." The stopping distance depends upon various factors, including: the speed of elevator cars 14 and 16 at the time limit switch 30 is tripped, the amount of time it takes for limit switch 32 to communicate to elevator controller 22, the amount of time it takes for elevator controller 22 to disengage drive machines 20 and engage brakes 21, and the length of time it takes for brakes 21 to bring elevator cars 14 and 16 to a complete stop.

To avoid a collision between elevator cars 14 and 16, it is desirable to maintain at least a minimum clearance distance between elevator cars 14 and 16 after they have come to a complete stop. The minimum clearance distance may be determined by building code, such as the American Society of Mechanical Engineers (ASME) A17.1 safety code for elevators and escalators. The location of actuator plate 30 on governor rope 24, however, should be greater than the minimum clearance distance away from elevator car 16. The distance between the top of elevator car 16 and actuator plate 30 (referred to as the safety threshold distance) should be at least the sum of the minimum clearance distance and maximum stopping distances of each of elevator cars 14 and 16, where the maximum stopping distance is calculated by considering the factors listed above or by experimental testing. The safety threshold distance will vary for every elevator system.

Figure 4:
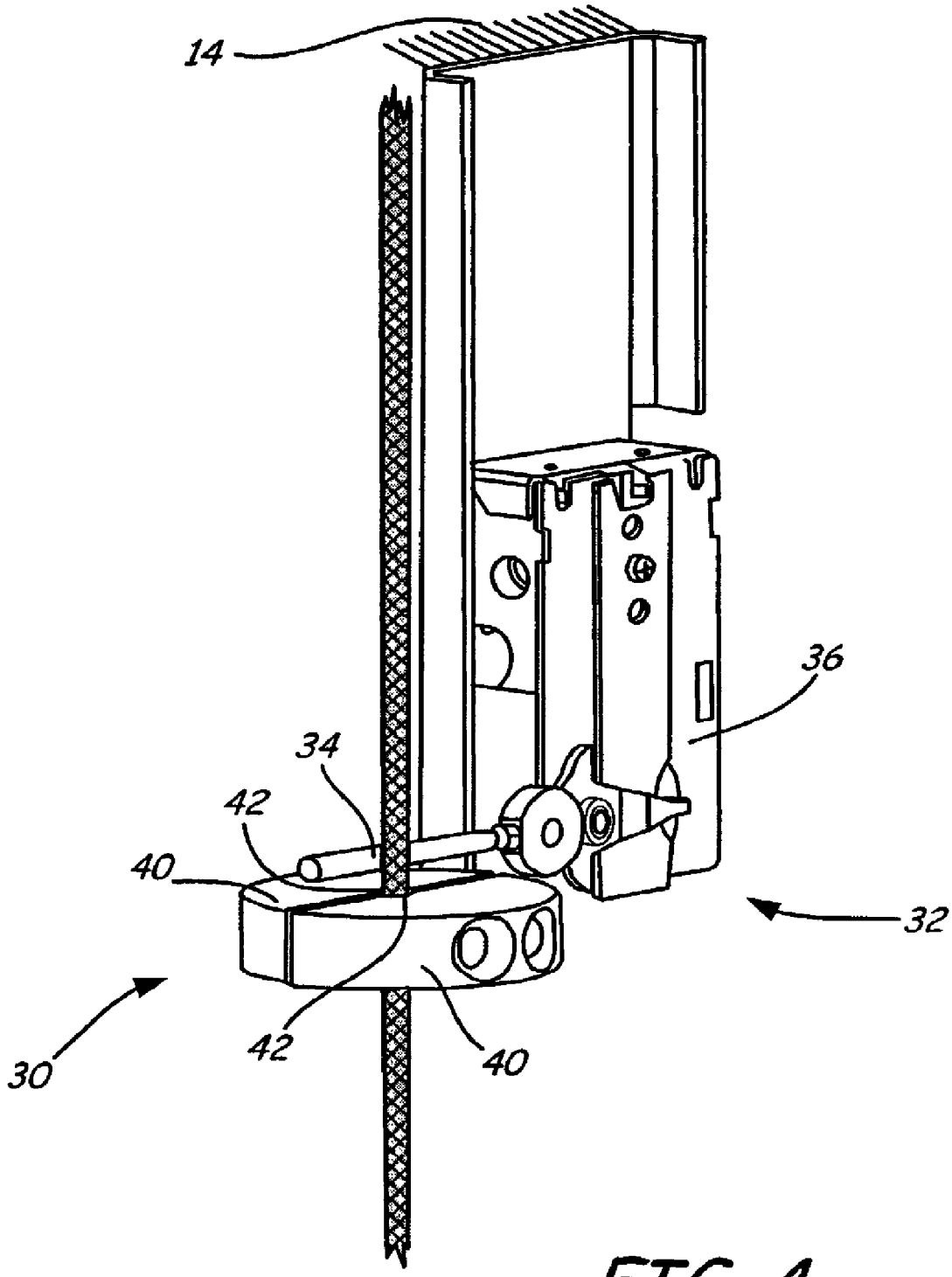
FIG. 4 is a perspective view of the actuator plate and the limit switch.

FIG. 4 is a perspective view of actuator plate 30 and limit switch 32. In one embodiment, actuator plate 30 is a doughnut-shaped plate constructed of two semi-circular disks 40. Semi-circular disks 40 contain notch 42 sized to fit around governor rope 24. Semi-circular disks 40 are bolted together around governor rope 24 to clamp governor rope 24. Actuator plate 30 extends out from governor rope 24 in a plane perpendicular to governor rope 24. Due to the tension on governor rope 24, actuator plate 30 remains within the vertical path of switch actuation rod 34 at all times. Actuator plate 30 can also be constructed in any other desired shape, such as a square plate, a cube, or a sphere.

Limit switch 32 includes switch box 36 and switch actuation rod 34. Switch box 36 contains an electrical switch and wires, and is connected to a lower portion of elevator car 14. Switch box 36 may be fastened directly to the lower portion of elevator car 14, adjacent governor rope 24, or can be connected by a rigid member, such as an angle bracket extending out and/or down from elevator car 14. Switch actuation rod 34 extends out from switch box 36, and is positioned a distance away from the governor rope that is less than a radius of the actuator plate, to ensure that actuator plate 30 will contact switch actuation rod 34 when the safety threshold distance is reached. It is recognized that other types of switches, sensors, or detectors could also be used to perform substantially the same function as limit switch 32 and actuator plate 30.

Although the present invention has been described with reference to preferred embodiments, workers skilled in the art will recognize that changes may be made in form and detail without departing from the spirit and scope of the invention. For example, the elevator safety system could be reversed with respect to elevator cars 14 and 16, such that limit switch 32 is connected to a top portion of elevator car 16, and actuator plate 30 is connected to the governor rope of elevator car 14. As another example, limit switch 32 could be wired directly to drive machines 20 and brakes 21, rather than being wired to elevator controller 22. Many other modifications will also be apparent.

What is claimed is:

1. An elevator safety system comprising:
a limit switch coupled to a first elevator car; and
an actuator plate coupled to a governor rope of a second elevator car, the actuator plate comprising a first plate section and a second plate section fastened together to surround and clamp to the governor rope, wherein the limit switch is configured to operably communicate with the actuator plate so as to trip the limit switch.

2. The elevator safety system of claim 1, wherein the actuator plate is positioned on the governor rope at least a safety threshold distance away from the first elevator car.

3. The elevator safety system of claim 1, further comprising:
drive machines for moving the first and second elevator cars;
brakes for stopping the first and second elevator cars; and
an elevator controller, for controlling the drive machines and the brakes.

4. The elevator safety system of claim 3, wherein the limit switch communicates a stop signal to the elevator controller when the limit switch is tripped.

5. The elevator safety system of claim 3, wherein the limit switch communicates a stop signal to the drive machines and the brakes when the limit switch is tripped.

6. The elevator safety system of claim 1, the limit switch comprising:
a switch box coupled to the first elevator car; and
a switch actuation rod extending outward from the switch box and adjacent to the governor rope.

7. The elevator safety system of claim 1, wherein:
the first plate section comprises a first semi-circular disk with a first notch; and
the second plate section comprises a second semi-circular disk with a second notch, wherein the first notch and the second notch are sized to engage the governor rope.

8. The elevator safety system of claim 7, the actuator plate further comprising a fastener to connect the first semi-circular disk to the second semi-circular disk to engage the actuator plate to the governor rope.

9. An elevator system comprising:
an elevator hoistway;
a first elevator car within the hoistway;
a second elevator car within the hoistway;
a governor rope extending from the first elevator car and adjacent to the second elevator car;
an actuator plate connected to the governor rope at least a safety threshold distance away from the first elevator car, the actuator plate comprising a first plate section and a second plate section fastened together to surround and clamp to the governor rope; and
a limit switch coupled to the second elevator car and adjacent the governor rope for stopping the first elevator car and the second elevator car.

10. The elevator system of claim 9, wherein the limit switch comprises:
an electrical switch connected to the second elevator car; and
a switch actuation rod connected to the electrical switch at one end, and extending outward from the electrical switch and adjacent to the governor rope.

11. The elevator system of claim 10, wherein the switch actuation rod is positioned less than a radius of the actuator plate away from the governor rope.

12. The elevator system of claim 9, wherein the safety threshold distance is the sum of a maximum stopping distance of the first car, a maximum stopping distance of the second car, and a minimum clearance distance.

13. A method of maintaining at least a minimum clearance distance between two elevator cars within the same hoistway, the method comprising:

operating a first elevator car and a second elevator car within the hoistway;

tripping a limit switch connected to the first elevator car with the actuator plate when a distance between the first elevator car and the second elevator car has gone below a safety threshold distance; and stopping the first elevator car and the second elevator car after tripping the limit switch;

wherein the limit switch is tripped by an actuator plate connected to a governor rope of the second elevator car, the actuator plate comprising a first plate section and a second plate section fastened together to surround and clamp to the governor rope.

14. The method of claim 13, wherein tripping the limit switch comprises pivoting a switch actuation rod and generating a stop signal.

15. The method of claim 13, further comprising communicating a stop signal from the limit switch to an elevator controller.

16. The method of claim 13, further comprising:

communicating a stop signal from the limit switch to a drive machine and to a brake.

17. The method of claim 13, wherein stopping the first elevator ca and the second elevator car comprises:

disengaging a drive machine with the elevator controller; and engaging a brake with the elevator controller.

18. The elevator system of claim 9, wherein the first plate section includes a first notch, the second plate section includes a second notch, and the first notch and the second notch are sized to engage the governor rope.

19. The method of claim 13 wherein the first plate section includes a first notch, the second plate section includes a second notch, and the first notch and the second notch are sized to engage the governor rope.

* * * * *

UNITED STATES PATENT AND TRADEMARK OFFICE

CERTIFICATE OF CORRECTION

PATENT NO. : 8,356,697 B2
APPLICATION NO. : 11/992609
DATED : January 22, 2013
INVENTOR(S) : John J. Kriss et al.

It is certified that error appears in the above-identified patent and that said Letters Patent is hereby corrected as shown below:

In the Specification

Col. 1, Line 13
Delete "to"

Col. 1, line 58
Delete "to"

Signed and Sealed this
Twenty-ninth Day of October, 2013

Teresa Stanek Rea
*Deputy Director of the United States Patent and Trademark Office*